United States Patent [19]

Rosenheck

[11] 4,126,355

[45] Nov. 21, 1978

[54] CHAIR WITH MULTI-POSITIONABLE SUPPORTING ELEMENTS

[76] Inventor: Thierry Rosenheck, 1868 Columbia Rd., N.W., Washington, D.C. 20009

[21] Appl. No.: 855,441

[22] Filed: Nov. 28, 1977

[51] Int. Cl.[2] ..... A47C 3/029; A47C 3/28

[52] U.S. Cl. ..... 297/258; 297/284; 297/345

[58] Field of Search ..... 297/284, 345, 118, 131, 297/270, 258, 313, 272

[56] References Cited

U.S. PATENT DOCUMENTS

| | | | |
|---|---|---|---|
| 1,241,357 | 9/1917 | Drosdowet | 297/131 X |
| 2,515,527 | 7/1950 | Robinson | 297/345 X |
| 2,591,911 | 4/1952 | Block | 297/345 X |
| 2,797,738 | 7/1957 | Patterson | 297/345 |
| 2,917,104 | 12/1959 | Cottle | 297/284 |
| 3,877,750 | 4/1975 | Scholpp | 297/284 |
| 3,934,932 | 1/1976 | Ekornes | 297/342 |

*Primary Examiner*—Francis K. Zugel
*Attorney, Agent, or Firm*—John Edward Roethel

[57] ABSTRACT

A multi-positionable chair is comprised of a pair of floor pods, a pair of arms, a back pad and a plurality of seat pads. Each floor pod is associated with an arm of the chair by means of a set of positioning tubes. The back pad and the seat pads are disposed between two floor pod-positioning tubes-armrest units. Various adjustments permit the chair to be positioned into a veritably infinite number of orientations.

6 Claims, 11 Drawing Figures

CHAIR WITH MULTI-POSITIONABLE SUPPORTING ELEMENTS

BACKGROUND OF THE INVENTION

This invention relates to the field of furniture; in particular, to that of chairs. The prior art contains a plethora of designs and configurations, many no doubt promoted as the ultimate in support and comfort. Maximum functionality in this art is effected by a chair that is appropriate for the widest possible uses.

The instant invention realizes this goal by providing a chair which is easily adjusted into a variety of orientations. The prior art attempts all have serious shortcomings that are ameliorated by the present invention.

U.S. Pat. No. 3,877,750 to Schlopp shows what is termed "reposing furniture" which merely is a plurality of members connected by joint means. Also used are tensioning cables and extension rods; the effect being a cumbersome device. U.S. Pat. No. 3,863,981 to Doyle shows fabric support areas suspended in a tubular frame structure.

Both of these patents are exemplary of the state of the prior art with respect to chairs adjustable into a variety of positions. It is self-evident that the adjustability of these chairs is either limited position-wise or complicated and time consuming.

Of further interest is U.S. Pat. No. 3,727,981 to Ostroff et al. which shows a conventional rocking chair that is disassembled into its component parts for shipping or storage.

SUMMARY OF THE INVENTION

The chair of the present invention improves upon the above-noted prior art chairs. The chair may easily and simply be adjusted into a variety of sitting positions from an upright, straight back position to a gentle reclining position. The floor pods forming the base of the chair can also be arranged such that the chair either rests flat on the floor or functions as a rocker.

This multi-positionability is achieved by the usage of two sets of positioning tubes to which the other parts forming the supporting elements of the chair are joined. The various chair configurations are realized by selecting the necessary relationship between the supporting elements and the positioning tubes. The desired flatness or curvature of the floor pods is achieved by adjusting the length of each positioning tube. The amount of recline of the back support and the contour of the seat pads is determined by an adjustment of their attachment to the positioning tubes.

An object of the present invention is to provide a chair capable of being oriented into a multitude of positions from straight, back upright to gentle reclining.

Another object is a chair being convertible from one resting flat on a floor to a rocker-type chair.

Another object is a chair that achieves multi-positionability without the necessity of adding or subtracting various part of the chair.

Another object is a chair that can be completely disassembled and packaged in a compact container for easy shipping or storage.

Another object is a chair whose orientation can be changed by manual adjustments without the use of tools.

Other objects will become apparent from the following detailed description of the invention.

DETAILED DESCRIPTION OF THE INVENTION

Figure 1:
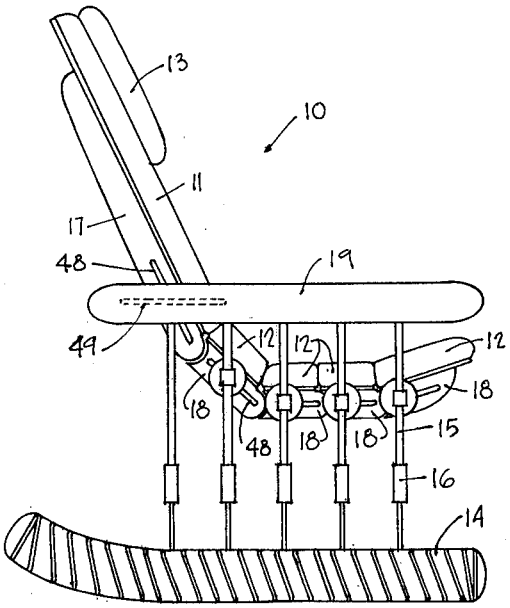
FIG. 1 is a side elevation of the chair of the present invention showing the floor pods in a flat orientation and the seat pads and back pads in a gentle recline position.
Figure 2:
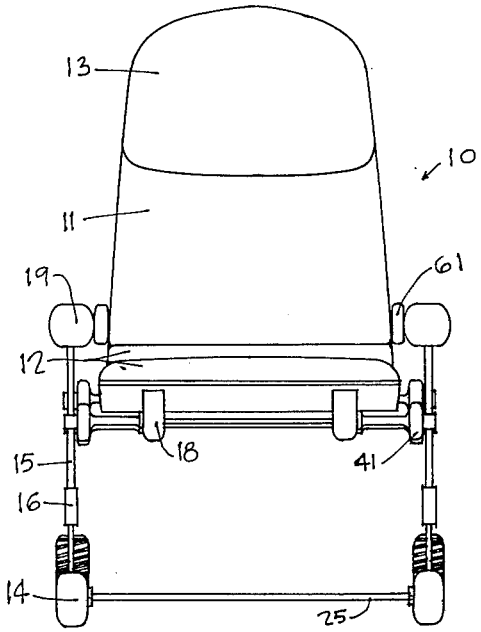
FIG. 2 shows a front elevation view of the chair oriented as in FIG. 1.

The basic chair 10 of the present invention is shown in FIGS. 1 and 2. A plurality of seat pads 12 and a back pad 11 form the sitting area. These pads are mounted on sets of seat pad supports 18 and a set of back pad supports 18, respectively. A head pad is attached to the back pad by any suitable fastening means, e.g. Velcro.

The seat and back parts of the chair are located between two identical armrest-positioning tubes-floor pod units. Between the armrest 19 and the floor pod 14 are located a plurality of positioning tubes 15. Each positioning tube 15 has associated therealong a locking tube 16 to permit telescopic adjustment of the length of each positioning tube 15. A plurality of floor pod bracing rods 25 (only one shown in FIG. 2) are positioned between the two floor pods 14 to add structural stability to the chair.

The back pad 11 and the seat pads 12 in FIGS. 1 and 2 have been oriented along the positioning tubes to effect a gentle recline when a person sits in the chair. Furthermore, the length of each positioning tube 15 has been selected to orient each armrest 19 to be parallel to the floor and to position each floor pod 14 to lie flat on the floor except for a slight upward curvature of each floor pod 14 at its rearward end.

Figure 3:
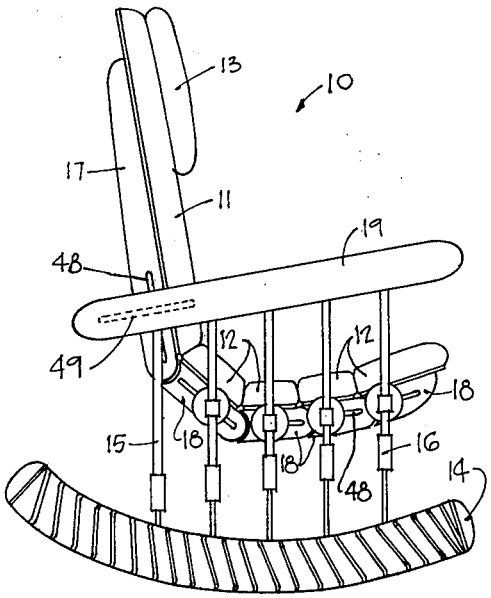
FIG. 3 shows a side elevation view of the chair with the floor pods in a rocker orientation and the back and seat pads set for a straight-back, upright sitting position.
Figure 4:
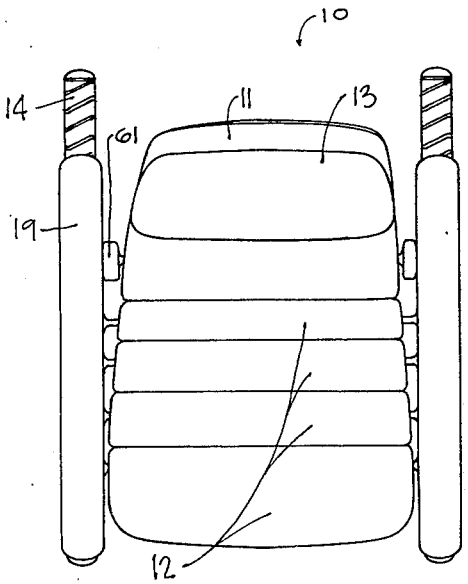
FIG. 4 is a top view of the chair as oriented in FIG. 3.
Figure 5:
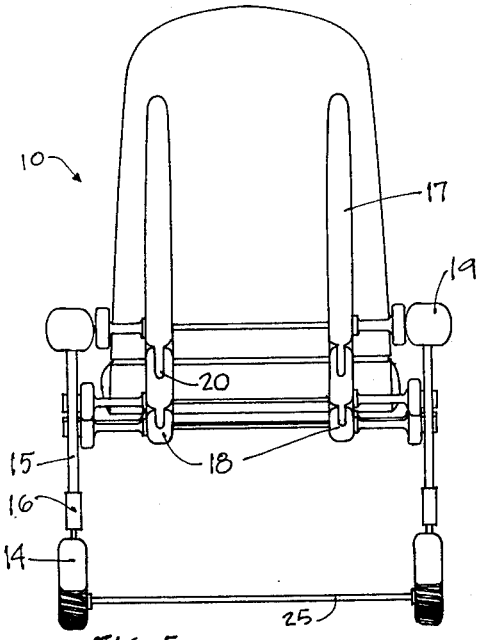
FIG. 5 is a back view of the chair as oriented in FIG. 3.

Alternatively, FIGS. 3, 4 and 5 show the chair 10 oriented such that the floor pods 14 are curved to convert the chair into a rocker. The back pad 11 and seat pads 12 have been positioned to effect a straight-back, upright sitting position and the armrests 19 are inclined upwardly toward the front of the chair. This combination is designed to make rocking easier.

FIG. 5 also shows the manner in which a back pad support 17 is hinged into the adjacent seat pad support 18. An extension 20 on back pad support 17 cooperates with the adjacent seat pad support 18; a lateral pin (not shown) may be used if desired to secure the necessary hinging action accomplished by this cooperation. A similar hinge is provided between adjacent seat pad supports 18, 18.

It should be apparent that four general adjustments can be made to the orientation of the chair and that each adjustment is independent of the other three. First, the angle of inclination of the armrests 19 can be varied; either inclined upwardly toward the front of the chair (FIG. 3), inclined downwardly toward the front of the chair (not shown), or parallel to the floor (FIG. 1). By the same adjustment, the height of the armrests relative to the floor can be varied.

Second, the curvature of the floor pads 14 is adjustably between flat (FIG. 1) and curved (FIG. 3). Since the amount of curvature is variable, the angle and speed of rocking can be adjusted to the pleasure of the person rocking.

Third, the angle of the back pad 11 and the curvature of the seat pads 12 can be adjusted to the personal taste of the chair's occupant. In this regard, the design of the chair permits a modicum of adjustment of the back pad 11 independent of the seat pads 12, and vice-versa.

Fourth, the height of the seat pads 12 (i.e. the vertical distance from the seat pads to the floor) can be adjusted to accommodate the length of the legs of the user. For example, a gentle reclining orientation (FIG. 1) of the chair contemplates a greater seat height while a rocker orientation (FIG. 3) would call for a lower seat height to permit maximum contact of the feet of the user with the floor to power the rocking action.

However, the unique construction of the chair of the present invention allows the user to select each of the four adjustments independently to orient the chair to his personal taste. For example, the gentle recline of the back pad 11 and seat pads 12 may be combined with the rocker orientation of the floor pods 14 and with any desired seat height and armrest angle or height. The manner in which these four adjustments are achieved will be hereinafter described.

Figure 6:
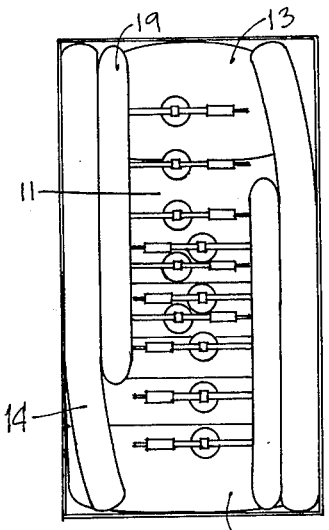
FIG. 6 shows the chair disassembled and packaged for shipping or storage in a compact container.

FIG. 6 illustrates a top view of the chair of the present invention set in a container for shipping or storage. The chair demounts into easily handled units—the back pad 11, the head pad 13 and the seat pads 12 are set on the bottom of the container. Each armrest 19 with the positioning tubes attached thereto are set in the container and each floor pod 14 is set along the sides of the container. The additional elements of the chair—the bracing rods 25, support rods 40, 60 and back and seat pad supports 17, 18 are placed in the container (not shown in FIG. 6). This particular disassembly technique allows for maximum shipping and storage feasibility.

Figure 7:
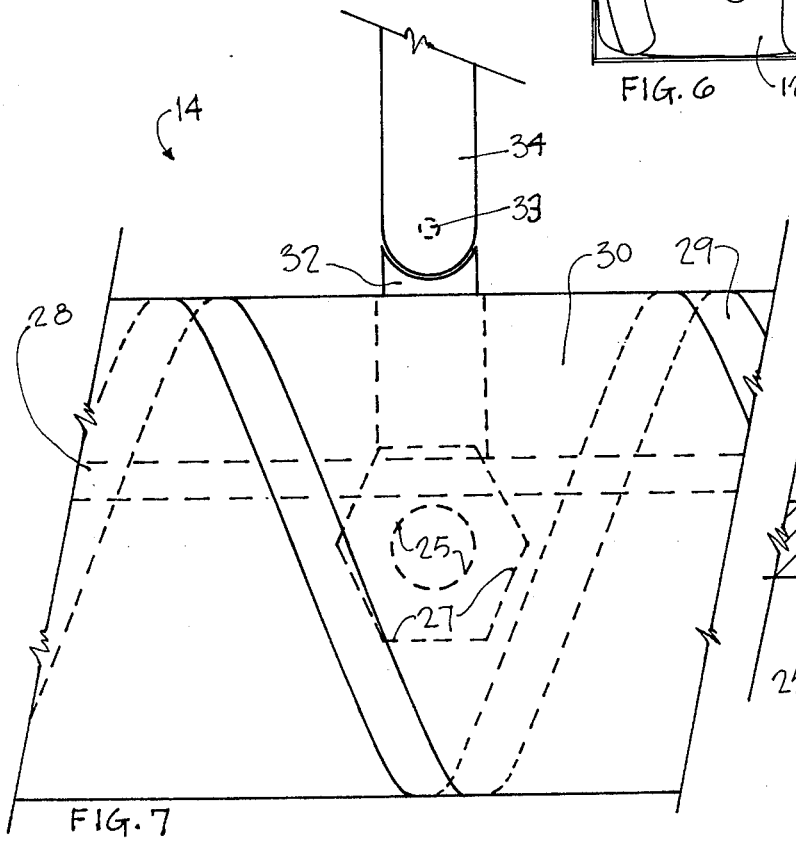
FIG. 7 is a detail elevation of one of the floor pods of the present invention.

FIG. 7 shows details of a floor pod of the present invention. Each floor pod is a flexible member formed from a wide helical wound resilient member 30 interconnected with a narrow helical wound metal member 29. The resilient member 30 imparts sufficient flexibility to the floor pod while the metal member 29 adds strength to the floor pod. Inside each floor pod is an inner pod longitudinal support 28 to further enhance the structural soundness of the pod.

Figure 8:
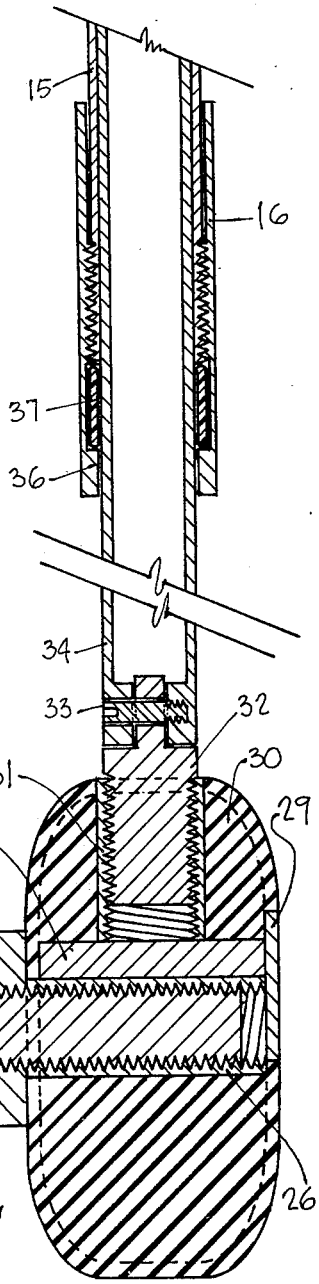
FIG. 8 shows a floor pod in detail section.

In FIG. 8, floor pod bracing rod 25 is shown threadably connected into a floor pod 14 by means of a connector tube 26 and a locknut 27. It is to be understood that the opposite end (not shown) of the floor pod bracing rod 25 is threaded similarly into the other floor pod 14 of the chair. Each positioning tube 15 is likewise threadably connected to a floor pod 14. A hinge connector 32 on the lower end of the positioning tube 15 threads into hinge connector tube 31 mounted in the floor pod. Hinge connector 32 is pivotably associated with the inside positioning tube 34 through lower hinge pin 33. This hinged connection permits needed play between the positioning tube 15 and the floor pod 14 when the floor pod is adjusted into a curved orientation.

FIG. 8 shows details of the manner in which each positioning tube 15 telescopes to vary its length. Inside positioning tube 34 slides inside positioning tube 15. Locking tube 16 is threaded onto positioning tube 15 and carries therebetween a compressible locking ring 37. When the appropriate length of positioning tube 15 has been selected, locking tube 16 is rotated on its threads to cause shoulder 36 to compress locking ring 37 which bears on inside positioning tube 34 and prevents relative movement between the latter and positioning tube 15. Rotation of locking tube 16 in the opposite direction relieves the compression and permits length adjustment of positioning tube 15.

Figure 9:
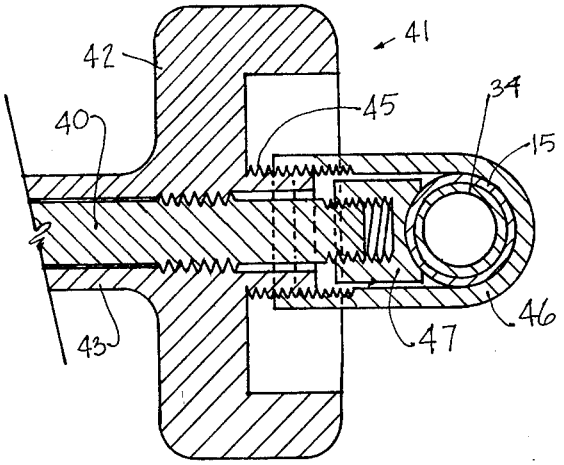
FIG. 9 is a detail plan section of a seat locking knob of the present invention.
Figure 10:
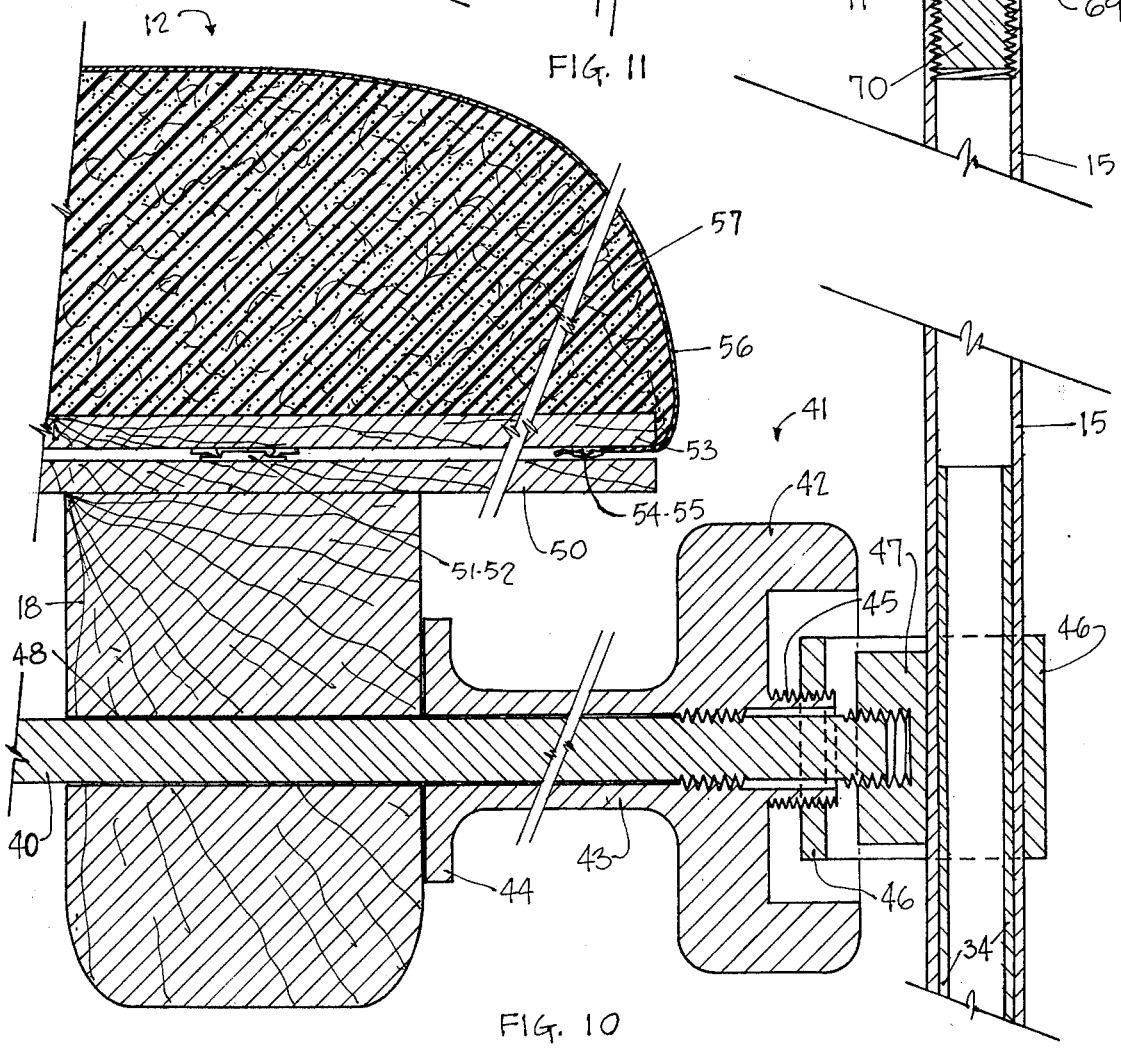
FIG. 10 shows a detail section elevation view of a seat locking knob and its connections to a seat pad and a positioning tube.

FIGS. 9 and 10 show the manner in which the positioning tubes 15 are associated with the seat pads 12. Seat support rod 40 as shown in FIG. 10 joins positioning tube 15 with seat pad support 18; it being understood that a similar positioning tube-seat pad support combination is joined at the other side of the chair by means of the other end of seat support rod 40. Seat support rod 40 passes through a longitudinal slot 48 cut in each seat pad support 18. This permits each seat pad 12 and seat pad support 18 to "float" on seat support rod 40 and thus allows for the necessary adjustments in the orientations of the seat pads 12. The end of seat support rod 40 is threaded into inner clamping foot 47. Inwardly from the end of seat support rod 40 is threaded thereon seat locking knob 41 which comprises a seat locking knob foot 44 at the end of the seat locking knob body 43 which fits againt seat pad support 18, a seat locking knob head 42 and a seat locking knob extension 45. Ring-shaped outer clamp 46 is positioned about positioning tube 18 and threaded onto seat locking knob extension 45. When seat locking knob head 42 is appropriately rotated about seat supporting rod 40, both inner clamping foot 47 and ring-shaped outer clamp 46 are tightened against positioning tube 15. At the same time, seat locking knob foot 44 presses tightly against seat pad support 18. This combined movement firmly positions the seat pad 12 at the selected location along the length of the positioning tube 15. Each seat pad 12 has a seat locking knob 41 at each side of the chair between a respective seat pad support 18 and positioning tube 15.

FIG. 10 further illustrates the construction of each seat pad 12. Each set of seat pad supports 18 are mounted on a seat pad support mounting panel 50. Each seat pad 12 includes a seat pad mounting panel 53 and upholstery 56 with foam padding 57 therebetween. The ends of the upholstery 56 are attached to the seat pad mounting panel 53 by use of upholstery snaps 54, 55. The seat pad mounting panel 53 is joined to the seat pad support mounting panel 50 by connector clips 51, 52. This construction permits replacement of individual seat pads 12 when they become worn. The replacement can be done easily and quickly without the entire chair being taken out of use. The back pad 11 is both constructed and mounted on the back pad support 17 in a similar fashion.

Figure 11:
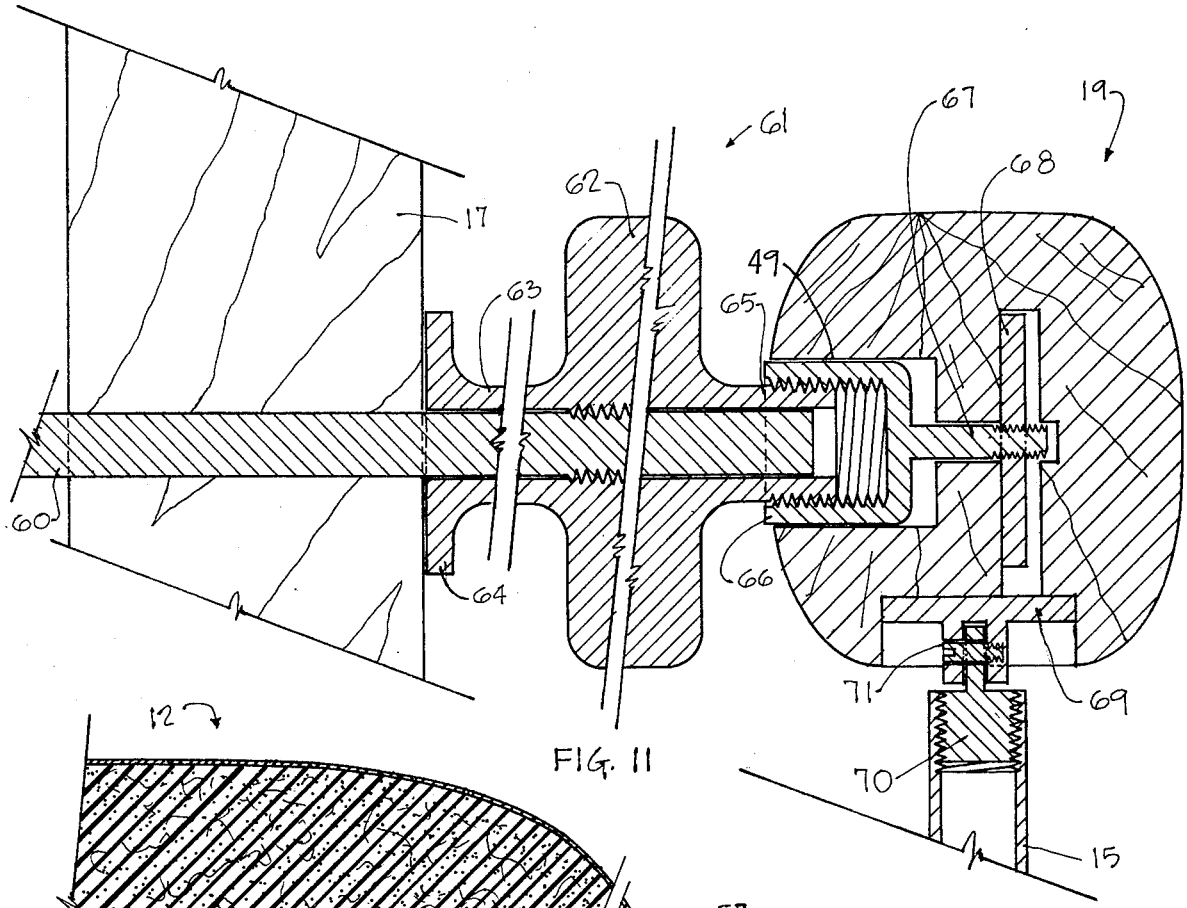
FIG. 11 shows a detail section elevation view of an arm locking knob and its connections to a back pad support and a positioning tube.

FIG. 11 shows the construction between the positioning tube 15, the armrest 19 and the back pad support 17. Again the construction shown in FIG. 11 is identical with that on the other side of the chair. Back pad support rod 60 extends laterally through each back pad support 17. The back pad support rod 60 likewise rides in longitudinal slot 48 to permit the back pad 11 to "float" and accommodate adjustment of the angle of the back pad.

Near the end of the back pad support rod 60 is threaded thereon an arm locking knob 61 which comprises an arm locking knob foot 64 at the inner end of the arm locking knob body 63. The foot 64 fits against back pad support 17. Arm locking knob heat 62 is at the opposite end of body 63 from foot 64, and head 62 terminates in an arm locking knob extension 65. This extension 65 fits threadably into a Y-shaped connector 66 which rides in a horizontal slot 49 in armrest 19. The extension leg 67 of the Y-shaped connector threaded into an arm connector locking member 68 positioned inside armrest 19. Similar to the operation of seat locking knob 41 in FIG. 10, appropriate rotation of arm locking knob 61 will cause feet 64 to wedge against back pad support 17 and will cause Y-shaped connector 66 to tension locking member 68. This combined effect will lock in place the selected orientation of the back pad 11. Again, opposite rotation of arm locking knob 61 will loosen up the unit and permit change in the orientation of back pad 11.

The underside of armrest 19 has mounted therein a T-shaped intermediate connector 69. Outside positioning tube connector 70 is threaded into the upper end of positioning tube 15 and pivotably connected to connector 69 by means of upper hinge pin 71. This hinged connection permits play when the angle of the armrest 19 is varied. A hinged connection of this type is provided at the upper end of each positioning tube 15.

The manner in which the previously mentioned four general adjustments of the chair can be made will now be described. In order to vary the angle or height of armrest 19, each locking tube 16 on one side of the chair is rotated to permit change in the length of each positioning tube 15. Appropriate selection of the length of the positioning tube 15 will give the desired angle or height to armrest 19. For example, as shown in FIG. 3, each positioning tube 15 from the back of the chair toward the front is set slightly longer which gives the armrest 19 an upwardly forward incline. After the desired angle is achieved, each locking tube 16 is rotated back to a tightening position to firmly hold each positioning tube 15 and thereby secure the angle of the armrest 19.

The curvature of the floor pods 14 is adjusted by use of these same locking tubes 16. Again by varying the length of positioning tubes 15, the curvature of each floor pod 14 can be selected (compare FIG. 1 to FIG. 3); after which, locking tubes 16 are rotated to their tightening position to firmly hold the curvature. The flexibility of the floor pods 14 permits a wide range of possible curvatures including the flat orientation of FIG. 1.

Even though telescoping positioning tubes 15 and locking tubes 16 are used to effect the adjustments of both the angle of armrest 19 and the curvature of floor pod 14, it should be apparent that each of these adjustments can be made independently of the other and are in no way dependent upon a particular orientation of one vis-a-vis the other.

The angle of the back pad 11 and the curvature of the seat pads 12 are varied by rotating seat locking knobs 41 and arm locking knobs 61. This loosening allows seat support rods 40 and back support rod 60 to slide in their respective longitudinal slots 48. Once the desired angle of the back pad 11 and seat pads 12 is achieved, the arm locking knobs 61 and the seat locking knobs 41 are rotated to the tightening position to firmly hold the back pad 11 and seat pads 12.

The fourth adjustment, viz. the height of the seat pads 12, is also achieved by means of the seat locking knobs 41 and the arm locking knobs 61. When these knobs are in their loosened position, the seat pads 12 and the seat support rod 40 can be slid up or down their respective positioning tube 15 by means of ring-shaped outer clamp 46 and inner clamping foot 47. Likewise, the back pad 11 can be raised and lowered by means of back pad support rod 60 sliding in the longitudinal slot 48 in the back pad support 17. Again, tightening of arm locking knobs 61 and seat locking knobs 41 fixes the position of the back pad 11 and seat pads 12 at the desired height.

The unique design of the chair permits manufacture of the various elements by mass production. Any suitable materials can be used and it is not intended that this disclosure be limited to the materials and fabrics indicated in the accompanying drawings. A customer can select the materials and fabrics to effect the decor style desired. In fact, the ease of interchangibility of the seat pads, back pad and head pad allows a customer to purchase sets of these parts so that different decorating styles can be accomplished from a single, base chair unit.

Thus there has been described a chair capable of being adjusted into a myriad of positions to accommodate the personal taste of any user. The unique design enables all adjustments to be performed without the necessity of using tools; all adjustments can be performed manually by a single person.

What is claimed is:

1. A chair comprising two floor pods, two armrests, two sets of adjustable positioning tubes, each floor pod adjustably connected to one of the armrests by one of the sets of positioning tubes, a plurality of seat pads disposed between the two sets of positioning tubes, each end of each seat pad being adjustably connected to a positioning tube at a location intermediate the armrest and the floor pod, and a back pad disposed between each armrest and connected thereto.

2. The chair of claim 1 including means for adjusting the angle of inclination or height relative to the floor of each armrest.

3. The chair of claim 1 including means for adjusting the curvature of each floor pod.

4. The chair of claim 1 including means for adjusting the angle of the back pad and the curvature of the seat pads.

5. The chair of claim 1 including means for adjusting the height of the seat pads.

6. The chair of claim 1 including a head pad attached to the back pad.

* * * * *